US007100211B2

(12) United States Patent
Bruffett

(10) Patent No.: US 7,100,211 B2
(45) Date of Patent: Sep. 5, 2006

(54) BIB HAVING AN INTERNAL POCKET FOR STORING ITEMS

(76) Inventor: Lynda L. Bruffett, 5613 Belle Chase La., Frisco, TX (US) 75035

( * ) Notice: Subject to any disclaimer, the term of this patent is extended or adjusted under 35 U.S.C. 154(b) by 0 days.

(21) Appl. No.: 10/419,657

(22) Filed: Apr. 21, 2003

(65) Prior Publication Data

US 2004/0205876 A1 Oct. 21, 2004

(51) Int. Cl.
*A41B 13/10* (2006.01)

(52) U.S. Cl. ..... 2/49.2

(58) Field of Classification Search ..... 2/49.2, 2/49.1–49.5, 48, 50–52, 102, 103, 97, 92, 2/463, 247, 468, 467, 69.5, 69, 94, 207; 224/257, 224/258; 150/100, 101, 102, 118, 107; D2/860, D2/861, 863, 864, 501, 502
See application file for complete search history.

(56) References Cited

U.S. PATENT DOCUMENTS 146,365 A * 1/1874 Singer ..... 2/92
345,899 A * 7/1886 Hill ..... 2/92
439,736 A * 11/1890 Webber ..... 2/49.4
593,618 A * 11/1897 Stackhouse ..... 2/49.5
681,806 A * 9/1901 Mignault ..... 2/92
879,124 A 2/1908 Thompson
889,073 A * 5/1908 Walbridge ..... 2/49.1
1,493,815 A * 5/1924 Hogan ..... 2/48
2,317,176 A * 4/1943 Byrd ..... 2/48
2,579,383 A * 12/1951 Goudsmit ..... 2/102
2,616,598 A * 11/1952 Sexton ..... 2/48
2,631,288 A * 3/1953 Daust ..... 2/49.3
2,635,243 A * 4/1953 Eskey ..... 2/49.2
2,694,199 A * 11/1954 Sanders ..... 2/49.2
2,835,895 A * 5/1958 Wells ..... 2/49.1
3,010,111 A 11/1961 Ralph
3,146,464 A 9/1964 Burnett
3,227,338 A * 1/1966 Hall ..... 224/602
3,286,279 A * 11/1966 Brown ..... 2/49.2
3,995,321 A 12/1976 Johnson
3,999,221 A 12/1976 Hannigan
4,227,270 A * 10/1980 Rivera ..... 5/639
4,441,212 A 4/1984 Ahr et al.
4,445,231 A 5/1984 Noel
4,601,065 A 7/1986 Sigl et al.
4,622,698 A * 11/1986 Heyman et al. ..... 2/48
4,649,572 A 3/1987 Roessler
4,779,288 A 10/1988 Mack
4,811,428 A 3/1989 Waldman et al.
4,811,768 A * 3/1989 Williams ..... 150/102
4,924,527 A 5/1990 Hintermeyer
5,072,455 A * 12/1991 St. Ours ..... 2/102
5,201,073 A 4/1993 Spanier
5,244,278 A 9/1993 Robitaille
5,432,952 A * 7/1995 Tate ..... 2/49.4
5,483,701 A 1/1996 Ferreyros
5,490,289 A 2/1996 Lehrer (Continued)

OTHER PUBLICATIONS

Gershman, Maurice, Journal of AMA, vol. 168, No. 7, Oct. 18, 1953.*

*Primary Examiner*—A. Vanatta
(74) *Attorney, Agent, or Firm*—Robert D. McCutcheon

(57) ABSTRACT

A bib includes an edge. The bib also includes an internal pocket. The pocket has an opening that extends along the edge of the bib.

19 Claims, 2 Drawing Sheets

U.S. PATENT DOCUMENTS 5,509,141 A 4/1996 Saltzman
5,918,311 A 7/1999 Lampson et al.
6,000,056 A 12/1999 Brady et al.
6,055,667 A * 5/2000 Jimenez ..... 2/49.1
6,058,506 A 5/2000 Reinhart, Jr.
6,128,780 A 10/2000 Reinhart et al.
6,145,134 A * 11/2000 Davis et al. ..... 2/247
6,237,150 B1 5/2001 Lucas
6,256,788 B1 7/2001 Loewer et al.
6,334,220 B1 1/2002 Frye
6,381,751 B1 5/2002 Benjamin et al.
2002/0069446 A1 6/2002 Pinckney et al.

* cited by examiner

BIB HAVING AN INTERNAL POCKET FOR STORING ITEMS

TECHNICAL FIELD

This disclosure is generally directed to bibs and more specifically to a bib having an internal pocket for storing items.

BACKGROUND

Feeding children and other people often requires the use of several items. For example, bibs are often used to keep infants or children and other people, along with their clothes, clean during feeding. As a particular example, a bib is typically placed around a child's neck and hangs in front of the child. Food that falls from utensils or the child's face often lands on the bib rather than on the child or the child's clothes. Feeding a child also often requires the use of one or more eating utensils, dishes, food and other related items. When transporting these items with a child, there exists a need for a bib that is able to carry such items within the bib itself, to reduce the number of individual items that may need to be packed and carried.

SUMMARY OF THE INVENTION

This disclosure provides a bib having an internal pocket for storing items.

In one embodiment, a bib includes an edge. The bib also includes an internal pocket. The pocket has an opening that extends along the edge of the bib.

In another embodiment, a bib includes a first section capable of at least partially facing a person wearing the bib and a second section capable of at least partially facing away from the person wearing the bib. The first and second sections of the bib are at least partially coupled to each other along a periphery of the first and second sections. The first and second sections form a pocket between the first and second sections. The bib also includes at least one fastener capable of allowing an opening to the pocket to form when unfastened and capable of closing the opening to the pocket when fastened. The at least one fastener is located along at least a portion of the periphery of the first and second sections.

One or more technical features may be present according to various embodiments of this disclosure. Particular embodiments of this disclosure may exhibit none, some, or all of the following features. For example, in one embodiment, a bib is provided that has at least one pocket. The pocket may be opened and closed so that items can be inserted in and removed from the pocket. In this way, items used to feed a child or other items can be stored in the bib, making storage and transport of the items more convenient.

Other technical features may be readily apparent to one skilled in the art from the following figures, descriptions, and claims.

BRIEF DESCRIPTION OF THE DRAWINGS

For a more complete understanding of this disclosure, reference is made to the following descriptions taken in conjunction with the accompanying drawings, in which.

DETAILED DESCRIPTION

Figure 1:
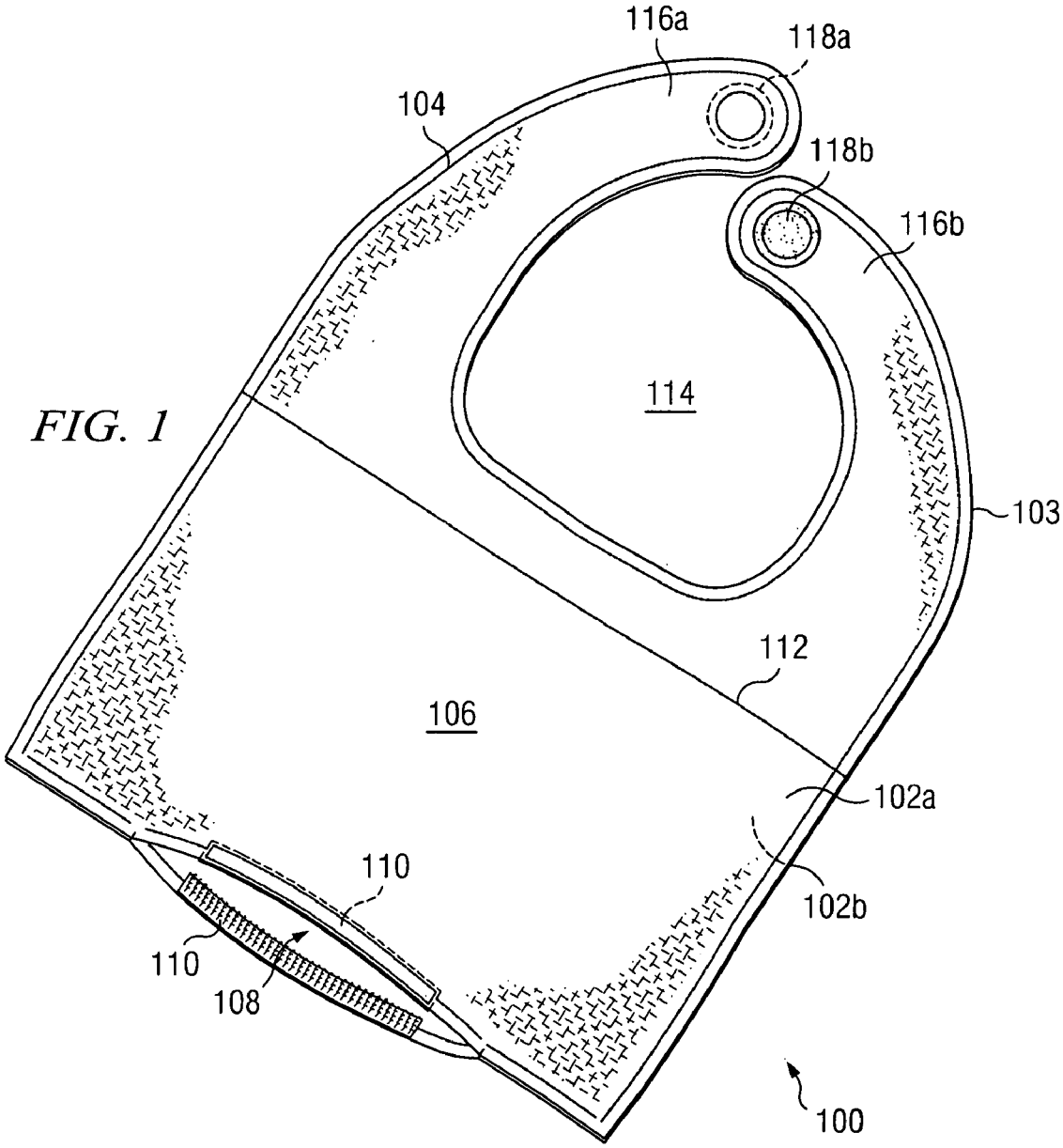
FIG. 1 is a diagram illustrating a bib according to one embodiment of this disclosure.

FIG. 1 is a diagram illustrating a bib 100 according to one embodiment of the present invention. In the illustrated embodiment, the bib 100 is formed from two sections 102*a* and 102*b* (referred to as "sections 102"). The sections 102 are formed of any suitable material or materials, including cloth, plastic or other materials. As a particular example, the sections 102 could be formed from a machine washable material. The section 102*a* may at least partially face away from an infant, a child or other person (referred hereinafter as "person") wearing the bib 100, while the section 102*b* may at least partially face the person wearing the bib 100. In the illustrated example, the sections 102 are coupled to each other at the periphery or edge 103 of the bib 100. The sections 102 may be connected to each other in any suitable manner, such as by stitching 104 or other connecting mechanism(s). The sections 102 may represent different portions of a single piece of material or separate pieces of material. Further, each individual section 102 could be formed from a single piece of material or multiple pieces.

In the illustrated embodiment, the bib 100 includes a pocket 106. The pocket 106 facilitates storage of items, such as eating utensils, dishes, food, or other items, in the bib 100. The pocket 106 is accessible through an opening 108. The opening 108 allows a person to insert and remove items from the pocket 106. In one embodiment, the opening 108 of the pocket 106 extends along at least part of the edge 103 of the bib 100. The opening 108 is opened and closed utilizing one or more fasteners 110. The fasteners 110 are connected to each other, which function to close the opening 108 of the pocket 106 and prevent items from falling out of the pocket 106. The fasteners 110 can also be disconnected, which function to open the opening 108 of the pocket 106 and allow items to be placed in and removed from the pocket 106. Fasteners 110 may be formed from Velcro, button(s), snap(s), zipper(s) or any other suitable materials or structures which provide an opening/closing function for a pocket or enclosure. In the exemplary embodiment, the pocket 106 is illustrated internally to the bib 100.

In a particular embodiment, the pocket 106 may include the entire area between the sections 102 of the bib 100. In another particular embodiment, the pocket 106 represents the area between portions of the sections 102. For example, in the illustrated example, the pocket 106 is formed between the bottom portion of each section 102, and a top 112 of the pocket 106 is positioned approximately in the middle of the bib 100. In a particular example, the top 112 is defined by a stitch across the middle of the bib 100. The stitch across the middle of the bib 100 may be optional. The top 112 of the pocket 106 could also be located at any suitable position in the bib 100 and defined by any other technique without departing from the scope of this disclosure. As will be appreciated, in another embodiment, a liner (not shown) may be positioned within the pocket 106.

As shown in FIG. 1, the bib 100 includes an opening 114, which allows the bib 100 to be placed around the neck of the person using the bib 100. The opening 114 of the bib 100 is formed by two extensions 116*a* and 116*b* (referred to as "extensions 116") that extend from opposite sides of the bib 100 and join to form the opening 114.

In one embodiment, the extensions 116 are connected and disconnected to facilitate placement of the bib 100 around the neck of the person wearing the bib 100. In the illustrated example, extensions 116 include connectors 118*a* and 118*b* (referred to as "connectors 118"). Connectors 118 may be formed from Velcro, buttons, snaps, or any other suitable connectors or connecting mechanism. While FIG. 1 illustrates two separate extensions 116 that are connected by connectors 118, extensions 116 may be permanently connected or replaced by a single, undivided segment that loops from one side of the bib 100 to the other side of the bib 100.

Although FIG. 1 illustrates one example embodiment of a bib 100, various changes may be made to bib 100. For example, the shape and proportions of the bib 100 are for illustrative purposes only, and other suitable shapes and proportions may be used. Also, FIG. 1 shows the opening 108 of the pocket 106 as spanning a portion, and in a preferred embodiment about one-half, of the bottom edge of the bib 100. It will be understood that the opening 108 may span any other portion of any edge of the bib 100, including the entire length of the bottom edge, or a portion of the side edges (or top edge) of the bib 100. Further, while FIG. 1 illustrates one fastener 110 connected to each section 102 of the bib 100, a single fastener 110 could be used in the bib 100. In addition, multiple pockets 106 can be formed in the bib 100, and the pockets 106 can have any suitable arrangement in the bib 100.

Figure 2:
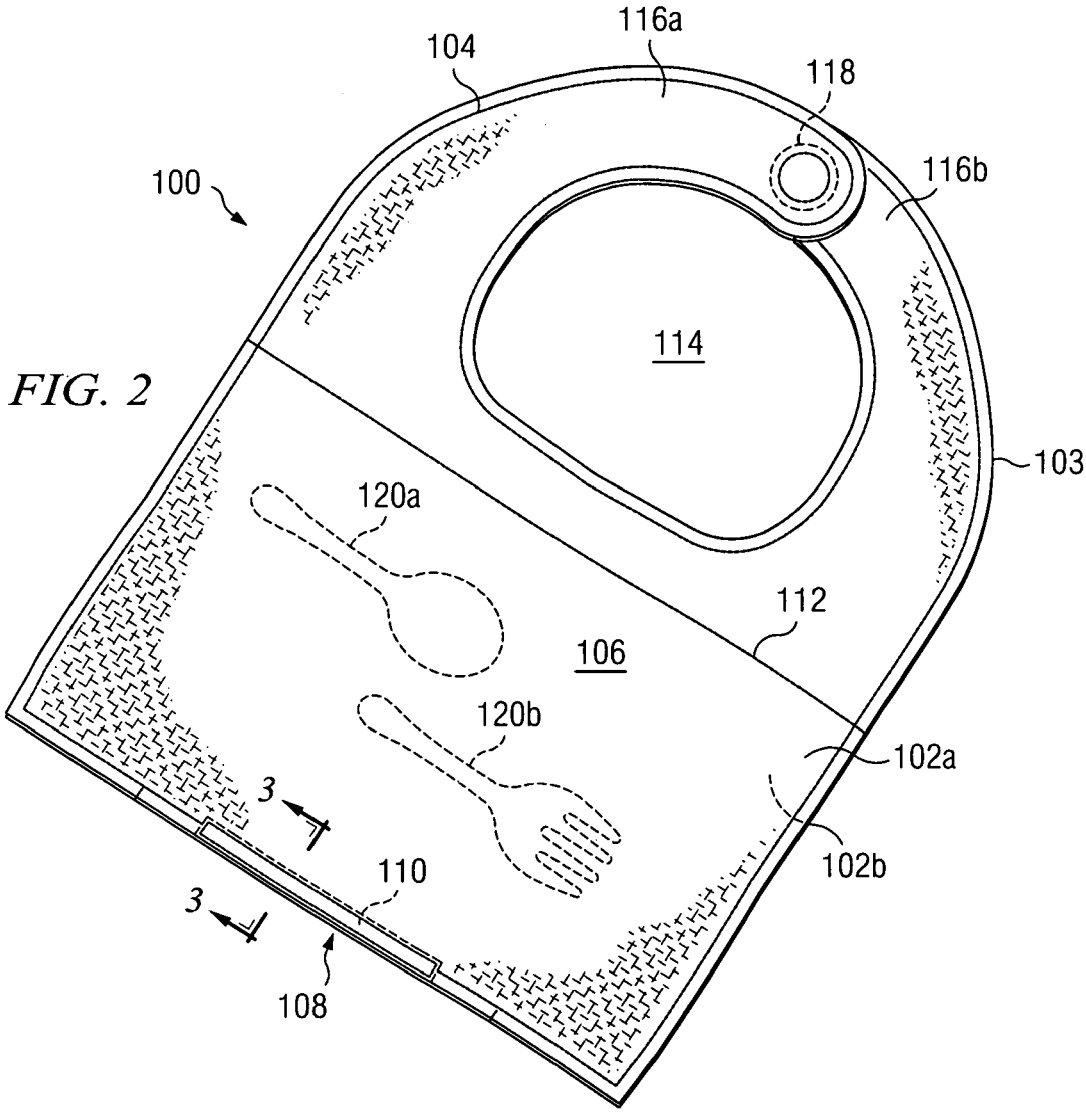
FIG. 2 is another diagram illustrating a bib according to one embodiment of this disclosure.

FIG. 2 is a diagram showing the bib 100 in accordance with one embodiment of the present invention. In particular, FIG. 2 illustrates the bib 100 of FIG. 1 after one or more items have been inserted into the pocket 106 of the bib 100.

In the illustrated example, the fastener 110 of the bib 100 has been connected, thereby closing the opening 108 of the pocket 106. Also, as shown in FIG. 2, two items 120*a* and 120*b* (referred to as "items 120") have been placed in the pocket 106 of the bib 100. The items 120 could represent any suitable items, such as utensils, food, dishes, glasses, napkins, towels or any other items. The items 120 may, but need not, represent items associated with feeding a child or other person wearing the bib 100.

To facilitate transport of the bib 100, the connectors 118 of extensions 116 can be connected. The connected extensions 116 can then be used as a handle to carry the bib 100. In this way, both the bib 100 and the utensils and other items 120 can be easily transported.

Although FIG. 2 illustrates two items 120 stored in the pocket 106 of the bib 100, any suitable number of items 120 can be stored in the pocket 106. Also, while the two items 120 illustrated in FIG. 2 are utensils, any other or additional types of items 120 can be stored in the pocket 106 of the bib 100.

Figure 3:
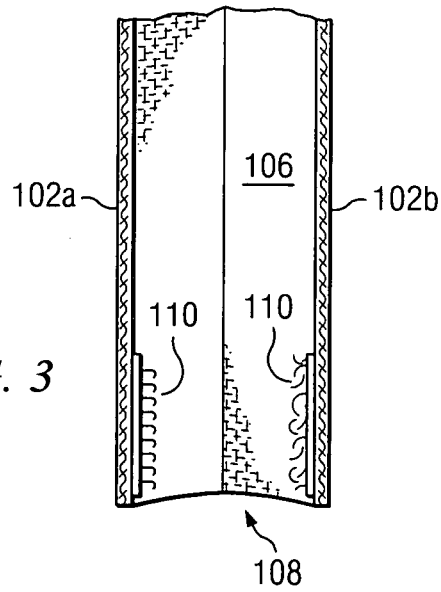
FIG. 3 is a diagram illustrating a cross-section of a bib according to one embodiment of this disclosure.

FIG. 3 is a diagram illustrating a cross-section of the bib 100. In particular, FIG. 3 illustrates the cross-section of the bib 100 along line 3-3 illustrated in FIG. 2.

As shown in FIG. 3, the two sections 102 of the bib 100 form a pocket 106 between the sections 102. Also, each section 102 of the bib 100 is connected to a fastener 110. The fasteners 110 can be disconnected and connected, which opens and closes an opening 108 of the pocket 106. In this way, items can be inserted and removed from the pocket 106 of the bib 100.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A bib, comprising:

a first section capable of at least partially facing a person wearing the bib;

a second section capable of at least partially facing away from the person wearing the bib, the first and second sections of the bib stitched to each other along at least a portion of a periphery of the first and second sections, the first and second sections forming an internal pocket between the first and second sections and forming an opening along at least a portion of a bottom periphery of the first and second sections; and at least one fastener capable of allowing the opening to the internal pocket to form when unfastened, the at least one fastener also capable of closing the opening to the internal pocket when fastened, the at least one fastener located along at least a portion of the bottom periphery of the first and second sections;

wherein the first and second sections comprise at least one extension forming a second opening, wherein the at least one extension is arranged to loop around and hang from a neck of the person wearing the bib, and wherein the at least one extension comprises a sole support for supporting the bib against the person wearing the bib, and wherein the at least one extension comprises two extensions extending from opposite sides of the bib, the extensions comprising connectors operable to connect the extensions to each other.

2. The bib in accordance with claim 1 wherein the at least one fastener comprises a hook and loop fastener.

3. The bib in accordance with claim 1 wherein the pocket represents an entire area between the first and second sections of the bib.

4. The bib in accordance with claim 1 wherein the pocket represents a portion of an area between the first and second sections of the bib.

5. The bib in accordance with claim 4 wherein the pocket is formed between a substantial portion of each of the first and second sections of the bib.

6. The bib in accordance with claim 1 wherein the at least one fastener is located along a bottom edge of the bib and the at least one fastener comprises a hook and loop fastener.

7. The bib in accordance with claim 6 wherein the at least one fastener spans at least a half of the bottom edge of the bib.

8. A method, comprising:

stitching at least a portion of a periphery of a first section of a bib to at least a portion of a periphery of a second section of the bib to form an internal pocket between the first and second sections and form an opening along at least a portion of a bottom periphery of the first and second sections, the first section capable of at least partially facing a person wearing the bib, the second section capable of at least partially facing away from the person wearing the bib; and coupling at least one fastener to at least one of the first and second sections of the bib along at least a portion of the periphery of the first and second sections, the at least one fastener capable of allowing the opening to the pocket to form when unfastened, the at least one fastener also capable of closing the opening to the pocket when fastened;

wherein the first and second sections comprise at least one extension forming a second opening, wherein the at least one extension is arranged to loop around and hang from a neck of the person wearing the bib, and wherein the at least one extension comprises a sole support for supporting the bib against the person wearing the bib, and wherein the at least one extension comprises two extensions extending from opposite sides of the bib; and coupling connectors to the extensions, the connectors operable to connect the extensions to each other.

9. The method in accordance with claim 8 wherein the at least one fastener comprises a hook and loop fastener.

10. The method in accordance with claim 8 wherein the pocket represents an entire area between the first and second sections of the bib.

11. The method in accordance with claim 8 wherein the pocket represents a portion of an area between the first and second sections of the bib.

12. The method in accordance with claim 11 wherein the pocket is formed between a lower portion of each of the first and second sections of the bib.

13. The method in accordance with claim 8 wherein coupling the at least one fastener comprises coupling the at least one fastener along a bottom edge of the bib and the at least one fastener comprises a hook and loop fastener.

14. The method in accordance with claim 13 wherein the at least one fastener spans at least a half of the bottom edge of the bib.

15. A bib, comprising:

a first side edge having a stitch for coupling a first piece of material to a second piece of material;

a second side edge having a stitch for coupling the first piece of material to the second piece of material;

a bottom edge formed by the first piece of material and the second piece of material;

an internal pocket formed between the first and second pieces of material and having an opening extending along the bottom edge, wherein the bottom edge includes a fastener operable for opening and closing the internal pocket; and at least one extension forming a second opening, wherein the at least one extension is arranged to loop around and hang from a neck of a person wearing the bib, and wherein the at least one extension comprises a sole support for supporting the bib against the person wearing the bib, and wherein the at least one extension comprises two extensions extending from opposite sides of the bib, the extensions comprising connectors operable to connect the extensions to each other.

16. The bib in accordance with claim 15 wherein the fastener includes a hook and loop fastener.

17. The bib in accordance with claim 16 wherein the opening spans at least a half of the bottom edge of the bib.

18. A bib, comprising:

a first piece of material capable of facing a child wearing the bib;

a second piece of material capable of facing away from the child wearing the bib;

first stitching coupling the first and second pieces of material to each other along a majority of a periphery of the first and second pieces of material;

first hook and loop fasteners coupling the first and second pieces of material to each other along a remaining portion of the periphery, the remaining portion of the periphery located along a bottom of the bib;

wherein a pocket is formed between lower portions of the first and second pieces of material, the first hook and loop fasteners capable of allowing an opening to the pocket to form when unfastened and capable of closing the opening when fastened;

wherein the first and second pieces of material comprise two extensions extending from opposite sides of the bib, wherein the extensions are collectively arranged to loop around and hang from a neck of the child wearing the bib, and wherein the extensions comprise a sole support for supporting the bib against the child wearing the bib the extensions comprising connectors operable to connect the extensions to each other.

19. The bib in accordance with claim 18 wherein the pocket represents an entire area between the first and second pieces of material.

* * * * *